US009919772B2

(12) United States Patent
Noguchi et al.

(10) Patent No.: US 9,919,772 B2
(45) Date of Patent: Mar. 20, 2018

(54) HULL SUPPORT STRUCTURE OF LIQUEFIED GAS TANK AND LIQUEFIED GAS CARRIER

(71) Applicant: KAWASAKI JUKOGYO KABUSHIKI KAISHA, Kobe-shi, Hyogo (JP)

(72) Inventors: Jun Noguchi, Kobe (JP); Yukiko Konno, Kobe (JP); Yusuke Shimizu, Kobe (JP); Takumi Yoshida, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 15/310,039

(22) PCT Filed: Apr. 21, 2015

(86) PCT No.: PCT/JP2015/002169
§ 371 (c)(1),
(2) Date: Nov. 9, 2016

(87) PCT Pub. No.: WO2015/174021
PCT Pub. Date: Nov. 19, 2015

(65) Prior Publication Data

US 2017/0152009 A1 Jun. 1, 2017

(30) Foreign Application Priority Data

May 15, 2014 (JP) ..... 2014-101525

(51) Int. Cl.
*B63B 25/08* (2006.01)
*B63B 3/56* (2006.01)
(Continued)

(52) U.S. Cl.
CPC ..... *B63B 25/08* (2013.01); *B63B 3/56* (2013.01); *B63B 3/70* (2013.01); *F17C 13/08* (2013.01);
(Continued)

(58) Field of Classification Search
CPC ..... B63B 25/00; B63B 25/08; B63B 25/12; B63B 25/14; B63B 25/16; B63B 3/56; B63B 3/70; F17C 13/08
(Continued)

(56) References Cited

U.S. PATENT DOCUMENTS 3,770,158 A * 11/1973 Alleaume ..... B63B 25/16 114/74 A
4,086,864 A * 5/1978 Ito ..... B63B 25/12 114/74 A
(Continued)

FOREIGN PATENT DOCUMENTS

DE 2050779 A1 5/1971
GB 1317940 A 5/1973
(Continued)

OTHER PUBLICATIONS

Jul. 14, 2015 International Search Report issued in International Patent Application No. PCT/JP2015/002169.
(Continued)

*Primary Examiner* — Lars A Olson
(74) *Attorney, Agent, or Firm* — Oliff PLC

(57) ABSTRACT

A hull support structure of a liquefied gas tank has a foundation deck disposed around a liquefied gas tank; a skirt which supports the liquefied gas tank on the foundation deck; an inner bottom plate extending in a hull length direction, at a location that is below the liquefied gas tank; and a pair of bilge hopper plates each of which is provided between the foundation deck and corresponding one of both
(Continued)

end portions of the inner bottom plate, wherein a plate connection section at which each of the pair of bilge hopper plates is connected to the foundation deck is disposed outward in a hull width direction, relative to a skirt connection section at which the skirt is connected to the foundation deck.

9 Claims, 6 Drawing Sheets

(51) Int. Cl.
*B63B 3/70* (2006.01)
*F17C 13/08* (2006.01)

(52) U.S. Cl.
CPC ..... *B63B 2025/087* (2013.01); *B63B 2701/14* (2013.01); *B63B 2701/18* (2013.01); *F17C 2201/0128* (2013.01); *F17C 2205/0103* (2013.01); *F17C 2205/013* (2013.01); *F17C 2205/0157* (2013.01); *F17C 2221/033* (2013.01); *F17C 2270/0105* (2013.01)

(58) Field of Classification Search
USPC ..... 114/74 A, 74 R
See application file for complete search history.

(56) References Cited

U.S. PATENT DOCUMENTS

| | | | | |
|---|---|---|---|---|
| 7,174,841 | B2 * | 2/2007 | Lindholm | B63B 25/16 114/74 A |
| 2010/0162939 | A1 * | 7/2010 | Morimoto | B63B 25/16 114/74 R |

FOREIGN PATENT DOCUMENTS

| | | | |
|---|---|---|---|
| JP | S52-51689 | A | 4/1977 |
| JP | S5251688 | A | 4/1977 |
| JP | H09-226682 | A | 9/1997 |
| JP | 2002-046686 | A | 2/2002 |
| KR | 2013-0066961 | A | 6/2013 |
| WO | 03/082665 | A1 | 10/2003 |

OTHER PUBLICATIONS

Jul. 14, 2015 Written Opinion issued in International Application No. PCT/JP2015/002169.
Nov. 22, 2017 Extended European Search Report issued in European Patent Application No. 15791982.0.

* cited by examiner

HULL SUPPORT STRUCTURE OF LIQUEFIED GAS TANK AND LIQUEFIED GAS CARRIER

TECHNICAL FIELD

The present invention relates to a hull support structure of a liquefied gas tank such as a spherical tank, and a liquefied gas carrier (transportation vessel) comprising the hull support structure.

BACKGROUND ART

Conventionally, to carry (transport) a liquefied gas such as a liquefied natural gas (hereinafter this will be referred to as "LNG"), a liquefied gas carrier (transportation vessel) including liquefied gas tanks is used. For example, as the liquefied gas carrier which carries the LNG, there is a liquefied gas carrier of a MOSS type, including a plurality of spherical liquefied gas tanks (cargo tanks: hereinafter this will be simply referred to as "spherical tanks"). Hereinafter, this liquefied gas carrier of the MOSS type will be exemplarily described.

As shown in FIGS. 5 and 6, a liquefied gas carrier 100 includes a plurality of spherical tanks 130 arranged in a forward and rearward direction of a hull 110 (hereinafter this will be referred to as a "hull length direction"). In this example, the liquefied gas carrier 100 includes four spherical tanks 130 arranged in the hull length direction.

FIG. 7 is a cross-sectional view showing a hull support structure of the spherical tank 130 disposed at the center portion of the hull. A pair of side shells 112 are provided on both sides of the hull 110 in a hull width direction to extend in the hull length direction. A pair of longitudinal bulkheads 113 are provided to extend in parallel with the side shells 112, respectively. A foundation deck 111 having a deck structure for supporting the spherical tank 130 is provided around the spherical tank 130. The spherical tank 130 is provided with a skirt (skirt structure) 135 which is a cylindrical structure for supporting the spherical tank 130 on the foundation deck 111. This skirt 135 is provided to extend downward from the equatorial segment of the spherical tank 130.

Further, an inner bottom plate 115 extending in the hull length direction is provided below the spherical tank 130. The both end portions of the inner bottom plate 115 in the hull width direction are connected to the foundation deck 111 via a pair of bilge hopper plates 117, respectively.

In the above-described conventional hull structure of FIG. 5, the foundation deck 111 provided at the center portion of the hull in the hull length direction, is located at a height H100 in the vicinity of a neutral axis in longitudinal bending of the hull.

As an exemplary prior art of the above-described hull structure, there is a hull support structure which supports a skirt extending downward from the equatorial segment of a spherical tank, on the upper surface of a foundation deck provided at a predetermined height position of the hull (see e.g., Patent Literature 1). In this hull support structure, foundation deck support sections of the skirt are partially located outward in the hull width direction relative to locations at which the bilge hopper plates are connected to the foundation deck.

CITATION LIST

Patent Literature

Patent Literature 1: Japanese Laid-Open Patent Application Publication No. Hei. 9-226682

SUMMARY OF INVENTION

Technical Problem

In the case of the above-described hull support structure of FIG. 7, as shown in FIGS. 8A and 8B, a skirt connection section 122 of the foundation deck 111 which supports the skirt 135 is located on the outer side of a plate connection section 120 at which the bilge hopper plate 117 is connected to the foundation deck 111, in a region that is in the vicinity of a center position of a cargo hold in the hull length direction (see FIG. 8A). In contrast, in a region that is other than the region that is in the vicinity of the center position of the cargo hold in the hull length direction, the skirt connection section 122 is located on the inner side of the plate connection section 120. For this reason, reinforcement members provided below the skirt 135 include reinforcement members 125 disposed between the foundation deck 111 and the bilge hopper plate 117 and reinforcement members 126 disposed between the foundation deck 111 and web frames 118 of the hull structure. In this way, the reinforcement members 125, 126 provided below the skirt 135 are disposed on the inner side of the bilge hopper plate 117 or the locations of the web frames 118 on the outer side of the bilge hopper plate 117, depending on the location of the skirt 135. As defined herein, throughout the description and claims, the term "inner side" refers to a side close to a center of the hull in the hull width direction, while the term "outer side" refers to an outer side in the hull width direction.

As shown in FIG. 9, the reinforcement members 125 provided on the inner side of the bilge hopper plate 117 have a shape such as a simple triangular shape, while the reinforcement members 126 provided on the outer side of the bilge hopper plate 117 have a substantially triangular shape at the locations of the web frames 118 in such a manner the upper portions of the reinforcement members 126 are expanded along the skirt 135 of a circular-arc shape so that the web frames 118 of the hull structure can bear a load applied from the skirt 135. As should be understood from this, the reinforcement members 126 have a complicated shape, and considerable time and labor are required to form the reinforcement members 126.

Since the reinforcement members 125 are disposed on the inner side of the bilge hopper plate 117, and the reinforcement members 126 are disposed on the outer side of the bilge hopper plate 117, considerable time is required to make the reinforcement member 125 and the reinforcement member 126 coplanar with each other, at an intersection of the reinforcement member 125 and the bilge hopper plate 117, and an intersection of the reinforcement member 126 and the bilge hopper plate 117. In particular, the outer region of the bilge hopper plate 117 is commonly used as a ballast tank section. This ballast tank section is in a highly corrosive environment, and is subjected to a heavy-duty coating. For this reason, considerable time and labor are required to perform a work for coating the reinforcement members 126 provided below the skirt 135.

In view of the above-described circumstances, an object of the present invention is to provide a hull support structure of a liquefied gas tank and a liquefied gas carrier (transportation vessel), which can simplify the hull support structure of the liquefied gas tank to reduce members of the hull support structure, and to allow a work to be performed more easily.

Solution to Problem

To achieve the above-described object, a hull support structure of a liquefied gas tank of the present invention, comprises a foundation deck disposed around a liquefied gas tank; a skirt which supports the liquefied gas tank on the foundation deck; an inner bottom plate extending in a hull length direction, at a location that is below the liquefied gas tank; and a pair of bilge hopper plates each of which is provided between the foundation deck and corresponding one of both end portions of the inner bottom plate, wherein a plate connection section at which each of the pair of bilge hopper plates is connected to the foundation deck is disposed outward in a hull width direction, relative to a skirt connection section at which the skirt is connected to the foundation deck.

In accordance with this configuration, the plate connection section at which each of the pair of bilge hopper plates is connected to the foundation deck is disposed outward in the hull width direction, relative to the skirt connection section at which the skirt is connected to the foundation deck, and these connection sections do not cross each other. This makes it possible to dispose reinforcement members provided below the skirt only on the inner side of each of the bilge hopper plates. Therefore, it is not necessary to dispose the reinforcement members provided below the skirt on the outer side of each of the bilge hopper plates. As a result, the number of members can be reduced. In addition, the structure of the reinforcement members supporting the skirt, and the like, can be simplified, and hence the hull structure can be simplified. Further, the number of work steps can be reduced.

The hull support structure of the liquefied gas tank may further comprise: a pair of longitudinal bulkheads extending in the hull length direction along side shells, respectively, wherein the plate connection section at which each of the pair of bilge hopper plates is connected to the foundation deck may conform in a position in the hull width direction to a bulkhead connection section at which each of the pair of longitudinal bulkheads is connected to the foundation deck.

In accordance with this configuration, the longitudinal bulkhead included in the hull structure and the bilge hopper plate included in the hull structure are connected to the foundation deck at the same position in a vertical direction. This makes it possible to improve the continuity of the hull structure, and the strength of the hull structure.

Each of the pair of bilge hopper plates may be configured to linearly connect the inner bottom plate to the foundation deck.

In accordance with this configuration, the stiffness of the bilge hopper plate included in the hull structure can be improved, and the number of work steps can be reduced.

A liquefied gas carrier (liquefied gas transportation vessel) of the present invention, comprises any one of the above-described hull support structures of the liquefied gas tank; and a plurality of liquefied gas tanks arranged in the hull length direction, each of the plurality of liquefied gas tanks being as recited above.

In accordance with this configuration, the hull support structure of the liquefied gas tank can be simplified, the weight of the hull and the number of work steps can be reduced, and manufacturing cost of the liquefied gas carrier can be reduced.

The foundation deck may be provided at an equal height over an entire hull cargo hold in the hull length direction.

In accordance with this configuration, the continuity of the hull structure can be secured. In addition, the height of the skirt can be reduced, and the weight of the hull can be reduced.

Advantages Effects of Invention

In accordance with the present invention, the hull support structure of the liquefied gas tank can be simplified, the members of the hull support structure can be reduced, and the work for supporting the liquefied gas tank on the hull can be performed more easily.

DESCRIPTION OF EMBODIMENTS

Hereinafter, the embodiment of the present invention will be described with reference to the drawings. In the embodiment described below, a liquefied gas carrier (transportation vessel) of a MOSS type, including a plurality of spherical tanks, will be exemplarily described.

Figure 1:
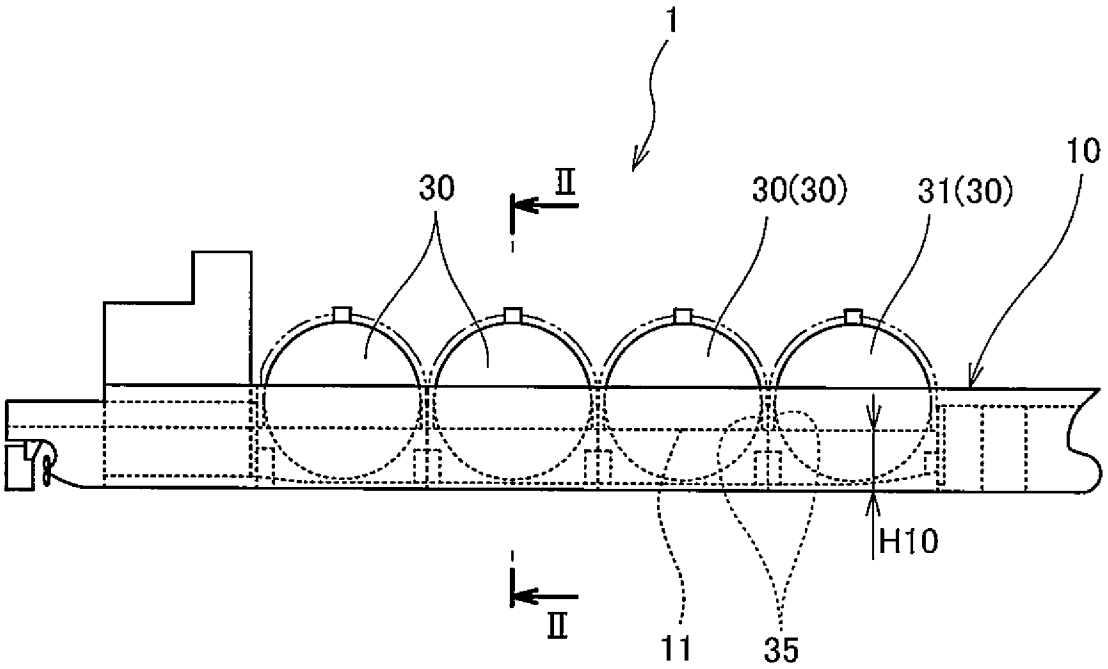
FIG. 1 is a side view showing a liquefied natural gas (LNG) carrier (transportation vessel) including a tank support structure according to the embodiment of the present invention.
Figure 5:
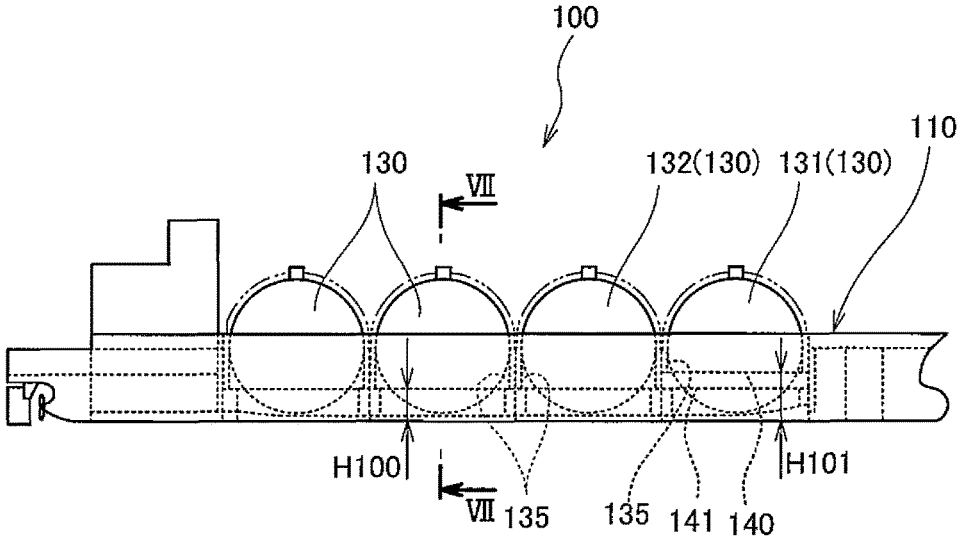
FIG. 5 is a side view showing a tank support structure of a conventional LNG carrier (transportation vessel).
Figure 6:
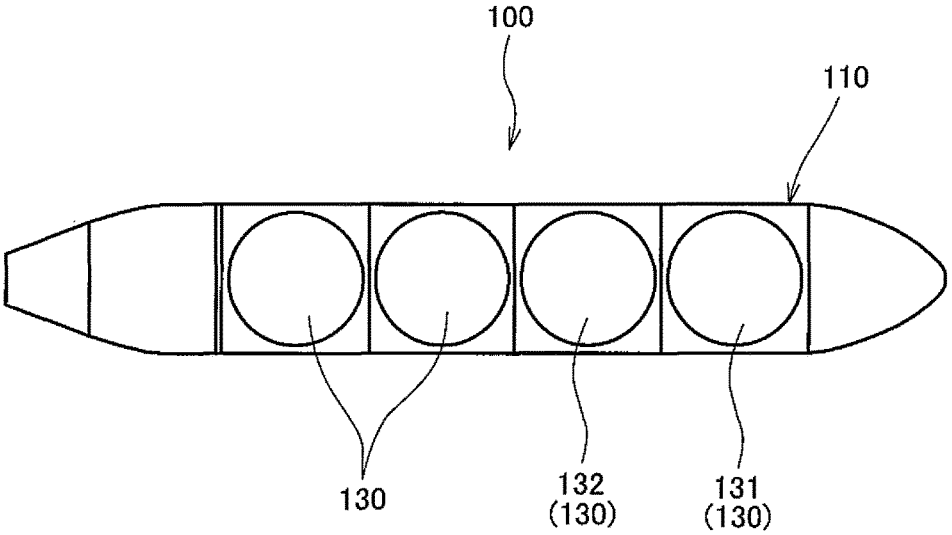
FIG. 6 is a plan view of the LNG carrier of FIG. 5.
Figure 7:
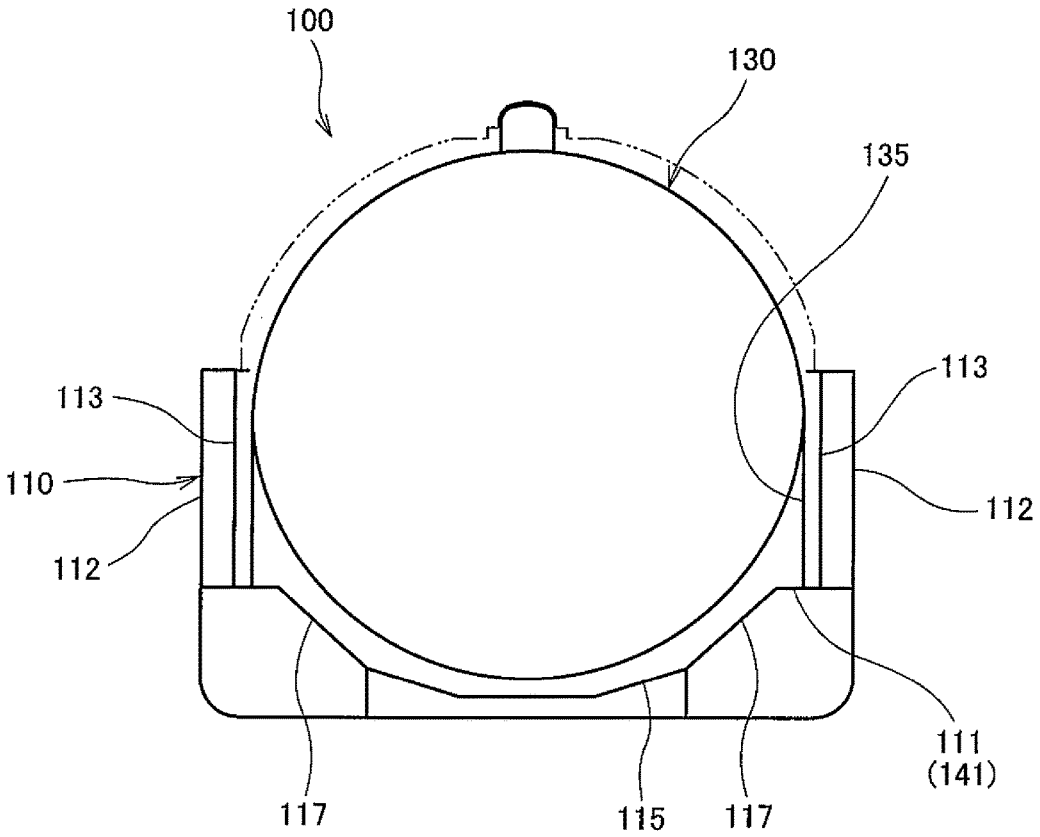
FIG. 7 is an enlarged cross-sectional view of the LNG carrier of FIG. 5, taken in the direction of arrows along line VII-VII of FIG. 5.
Figure 8A:
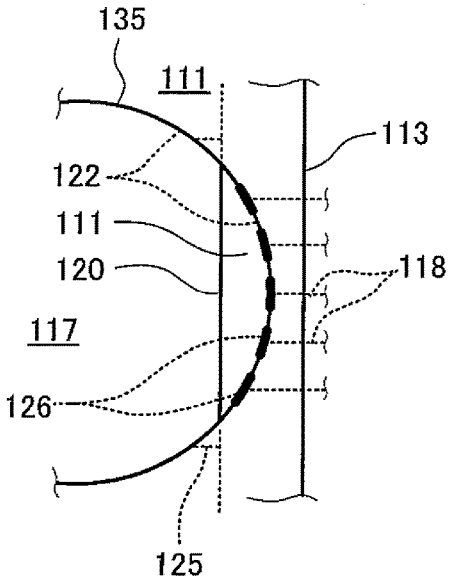
FIG. 8A is a plan view schematically showing a relation between the tank support structure and the hull structure, in the hull structure of FIG. 7.
Figure 8B:
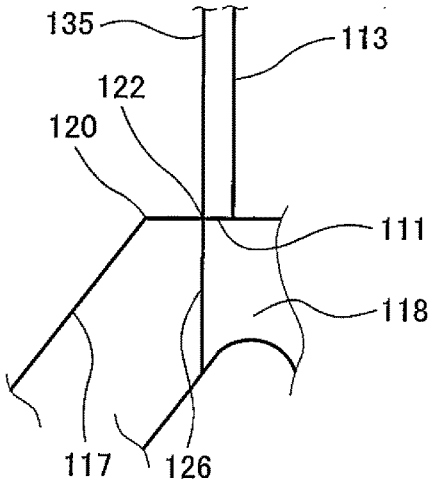
FIG. 8B is a cross-sectional view of a cargo hold center position, schematically showing the relation between the tank support structure and the hull structure, in the hull structure of FIG. 7.
Figure 9:
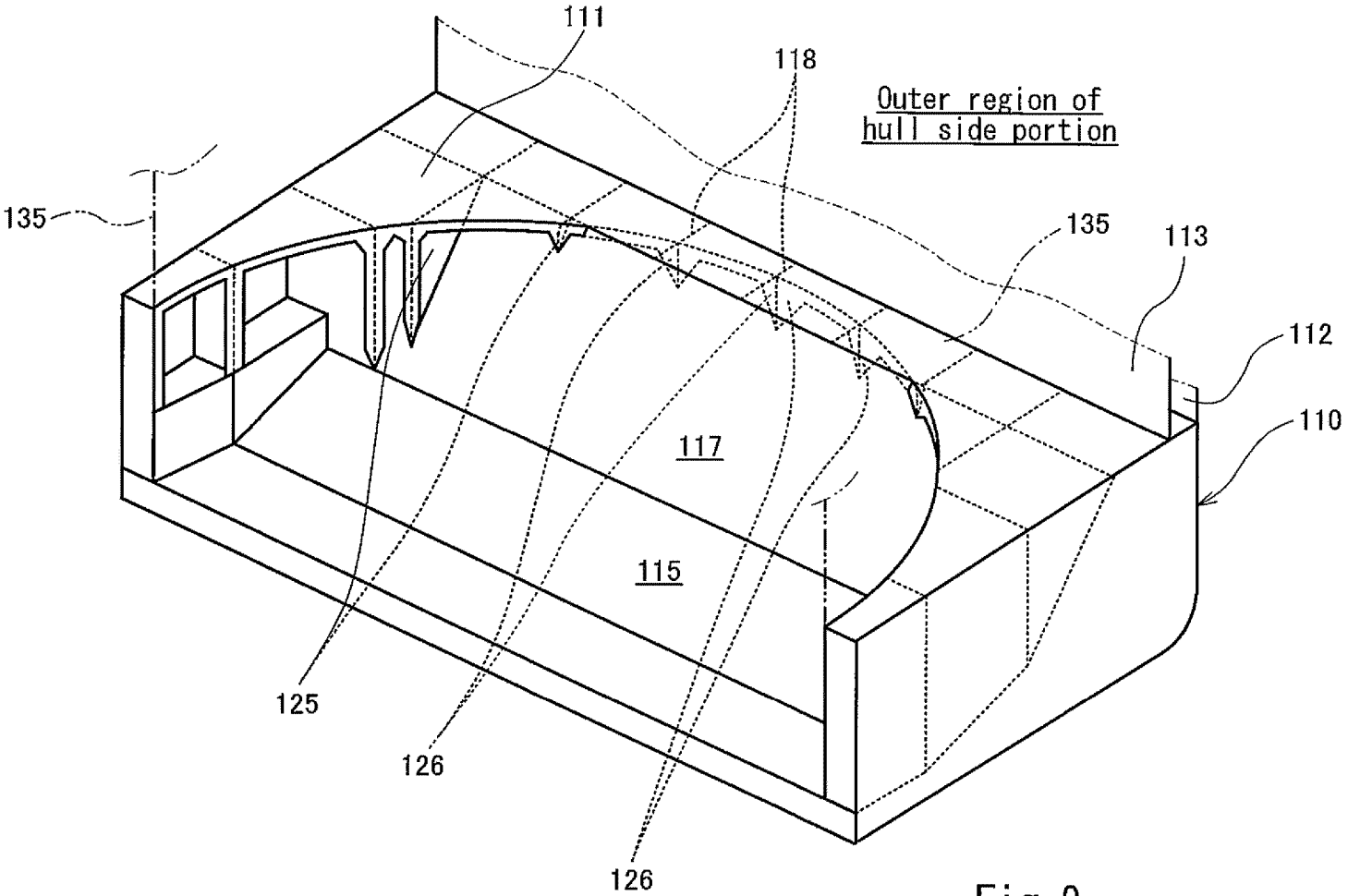
FIG. 9 is a perspective view showing a part of the hull structure of FIG. 7.

As shown in FIG. 1, a liquefied gas carrier (transportation vessel) 1 of the present embodiment includes a plurality of (four in this example) spherical tanks 30 arranged in a hull length direction of a hull 10. In the present embodiment, a foundation deck 11 having a deck structure for supporting these spherical tanks 30 is provided at a height H10 which is higher than that of the conventional hull structure (FIG. 5), and at an equal height over an entire hull cargo hold in the hull length direction. In the conventional hull structure, the foundation deck at the center portion of the hull is provided at a height (in a hull height direction) that is about 35 to 50% with respect to a base line. In contrast, the foundation deck 11 of the present embodiment is provided at the equal height H10 which is above 15 to 30% higher (in the hull height direction) than that of the conventional hull structure, over the entire hull cargo hold in the hull length direction.

Since the entire foundation deck 11 in the hull length direction is set at the equal height H10 which is higher than that of the conventional hull structure, in the above-described manner, a continuity of the hull structure between a first spherical tank 31 and a second spherical tank 32 can be secured. Specifically, in the above-described conventional hull structure of FIG. 5, a foundation deck 140 supporting a first spherical tank 131 at a bow of the hull 110, which has a dimension reduced in the hull width direction, is provided at a height H101 which is higher than the height H100 of the foundation decks 111 for a second spherical tank 132 at the center portion of the hull, and the following tanks. This makes it possible to prevent the skirt 135 of the first spherical tank 131 from interfering with the side shells, an inner shell member, and the like. However, in this conventional hull structure, the continuity of the hull structure between the first spherical tank 131 and the second spherical tank 132 cannot be secured. However, in accordance with the above-described foundation deck 11, the continuity of the hull structure can be secured.

In addition, an additional deck 141 provided continuously with the foundation deck 111 at the location of the first spherical tank 131 in the conventional hull structure may be omitted. Because of the omission of the additional deck 141, the weight of the hull, including reinforcement members used for connection of these decks, and the like, can be reduced.

Further, since the foundation deck 11 is disposed at the higher location, skirts (skirt structures) 35 for supporting the spherical tanks 30, including the skirt (tank skirt) 35 of the first spherical tank 31, can be disposed to be at an equal and reduced height. This makes it possible to reduce the weight of the skirt 35 having a large plate thickness. In this respect, the weight of the hull can also be reduced.

Figure 2:
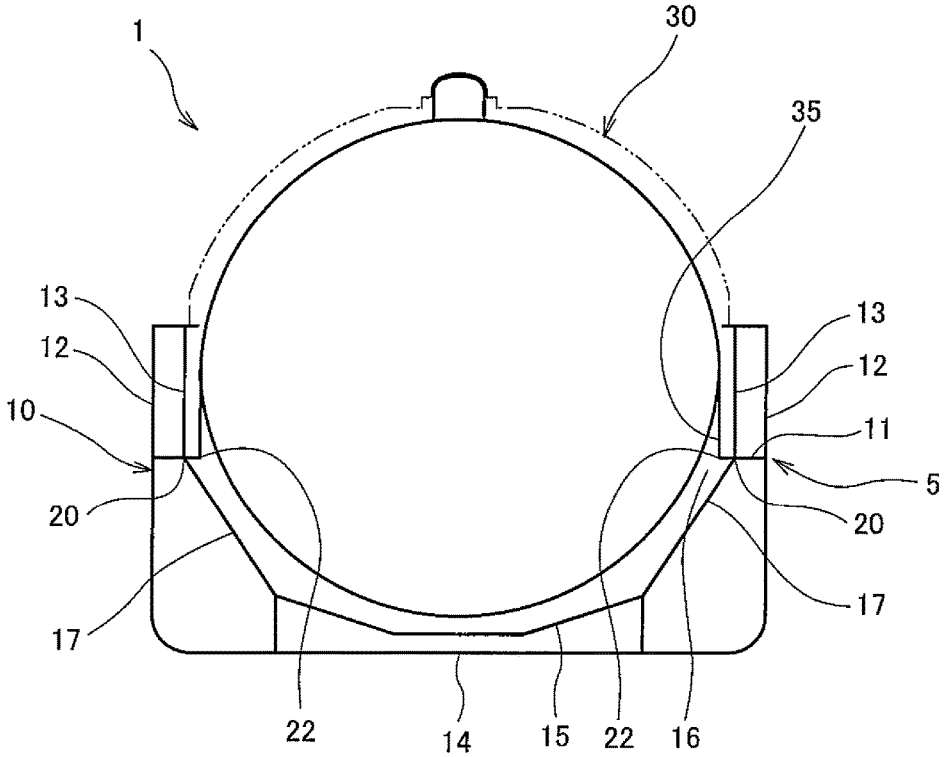
FIG. 2 is an enlarged cross-sectional view of the LNG carrier of FIG. 1, taken in the direction of arrows along line II-II of FIG. 1.

FIG. 2 is a cross-sectional view showing the hull support structure of the spherical tank 30 at the center portion of the hull 10. A hull support structure 5 includes a pair of side shells 12 extending in the hull length direction, on the both sides of the hull 10 in the hull width direction, and a pair of longitudinal bulkheads 13 which are provided inward at a predetermined distance from the pair of side shells 12, respectively, and extend in the hull length direction along the pair of side shells 12, respectively. In addition, a bottom plate 14, and an inner bottom plate 15 extending in the hull length direction along the bottom plate 14 at a location that is at a predetermined distance from the bottom plate 14 and above the bottom plate 14, are provided below the spherical tank 30.

The foundation deck 11 is provided around the spherical tank 30 to support the spherical tank 30. The foundation deck 11 is provided to connect the pair of side shells 12 to each other in the hull width direction. A circular opening 16 with a size which is substantially equal to the inner diameter of the cylindrical skirt 35 is provided at a location at which the spherical tank 30 is provided. The pair of longitudinal bulkheads 13 are connected to the upper surface of the foundation deck 11.

A pair of bilge hopper plates 17 are provided in such a manner that each of them is disposed between the corresponding one of the both end portions of the inner bottom plate 15 in the hull width direction, and the lower end portion of the corresponding one of the pair of longitudinal bulkheads 13. The bilge hopper plates 17 also extend in the hull length direction. The bilge hopper plates 17 are inclined outward in the hull width direction, as they extend from the both end portions of the inner bottom plate 15. In the present embodiment, plate connection sections 20 at which the bilge hopper plates 17 are connected to the foundation deck 11 conform in positions in the hull width direction to bulkhead connection sections 21 at which the longitudinal bulkheads 13 are connected to the foundation deck 11, respectively. In this configuration, the bilge hopper plates 17 of the hull structure are connected to the longitudinal bulkheads 13 of the hull structure, respectively, via the foundation deck 11. As a result, the continuity of the hull structure and the strength of the hull structure can be improved.

In the present embodiment, the foundation deck 11 and the inner bottom plate 15 are connected to each other via the pair of bilge hopper plates 17 extending linearly (having a linear shape). In other words, the inner bottom plate 15 and the foundation deck 11 are linearly connected to each other via the pair of bilge hopper plates 17 of a flat plate shape. By linearly connecting the bilge hopper plates 17 to the bulkhead connection sections 21, respectively, at which the longitudinal bulkheads 13 are connected to the foundation deck 11, in the above-described manner, the stiffness of the hull structure can be improved, and the number of work steps can be reduced. Alternatively, the bilge hopper plates 17 may be connected to the bulkhead connection sections 21, respectively, in a manner which is different from the linear manner. For example, the bilge hopper plates 17 may be curved or bent several times.

The skirt 35 which is the cylindrical structure extending downward from the equatorial segment of the spherical tank 130 is supported on the foundation deck 11.

Figure 3A:
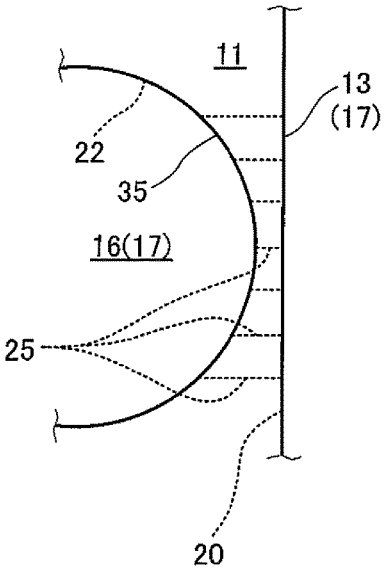
FIG. 3A is a plan view schematically showing a relation between a tank support structure and the hull structure, in the hull structure of FIG. 2.

As shown in FIG. 3A, regarding a relation between the tank support structure and the hull structure in this example, the plate connection section 20 at which each of the bilge hopper plates 17 is connected to the foundation deck 11 is disposed outward in the hull width direction, relative to a skirt connection section 22 at which the skirt 35 is connected to the foundation deck 11. This makes it possible to prevent a situation in which the skirt connection section 22 and the plate connection section 20 cross each other at a location of the foundation deck 11. More specifically, the skirt connection section 22 which is a contact line of the foundation deck 11 and the skirt 35 which support the liquefied gas tank 30 of the MOSS type, and the plate connection section 20 which is a contact line of the foundation deck 11 and the bilge hopper plate 17 do not cross each other, at the connection sections with the foundation deck 11.

Figure 3B:
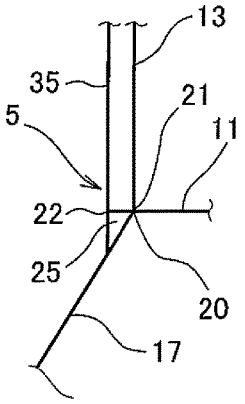
FIG. 3B is a cross-sectional view of a cargo hold center position, schematically showing the relation between the tank support structure and the hull structure, in the hull structure of FIG. 2.

As shown in FIG. 3B, in a vertical cross-section of a connection portion at which the skirt 35 is connected to the foundation deck 11, the connection portion being located on an outermost side in the hull width direction, the foundation deck 11 extends inward relative to the plate connection section 20 at which the bilge hopper plate 17 is connected to the foundation deck 11, and the inner end portion of the foundation deck 11 supports the skirt 35.

Since the skirt 35 and each of the bilge hopper plates 17 are connected to the foundation deck 11 in the above-described manner, reinforcement members 25 provided below the skirt 35 are disposed only on the inner side of the bilge hopper plate 17. In other words, since the skirt 35 is not located on the outer side of the bilge hopper plate 17, it is not necessary to provide the reinforcement members 25 on the outer side of the bilge hopper plate 17. Therefore, the reinforcement members 25 can have a simple structure, and the number of members can be reduced. As a result, it becomes possible to obtain advantages in that the hull structure can be simplified, and the number of members of the hull structure can be reduced.

Figure 3C:
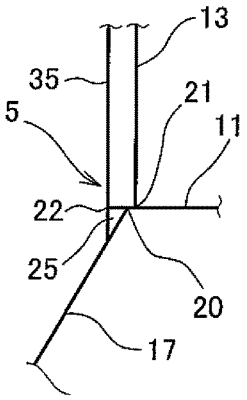
FIG. 3C is a cross-sectional view of a modified example of a configuration of FIG. 3B, schematically showing the relation between the tank support structure and the hull structure, in the hull structure of FIG. 2.

As shown in FIG. 3C, the plate connection section 20 at which each of the bilge hopper plates 17 is connected to the foundation deck 11 may be deviated in the hull width direction, from the bulkhead connection section 21 at which each of the longitudinal bulkheads 13 is connected to the foundation deck 11. The plate connection section 20 at which each of the bilge hopper plates 17 is connected to the foundation deck 11 may be disposed outward in the hull width direction, relative to the skirt connection section 22 at which the skirt 35 is connected to the foundation deck 11, to prevent the plate connection section 20 from crossing the skirt connection section 22 of the skirt 35 at a location of the foundation deck 11.

In brief, it is sufficient that the plate connection section 20 at which each of the bilge hopper plates 17 is connected to the foundation deck 11 is disposed outward in the hull width direction, relative to the skirt connection section 22 at which the skirt 35 is connected to the foundation deck 11. With the above-described hull support structure 5, the reinforcement members 25 provided below the skirt 35 may be disposed only on the inner side of the bilge hopper plate 17, and it is not necessary to provide the reinforcement members 25 on the outer side of the bilge hopper plate 17. This makes it possible to significantly improve the work efficiency. Although only the right part of the hull is shown in FIGS. 3A to 3C, the right part and the left part in the hull width direction have the same support structure.

Figure 4:
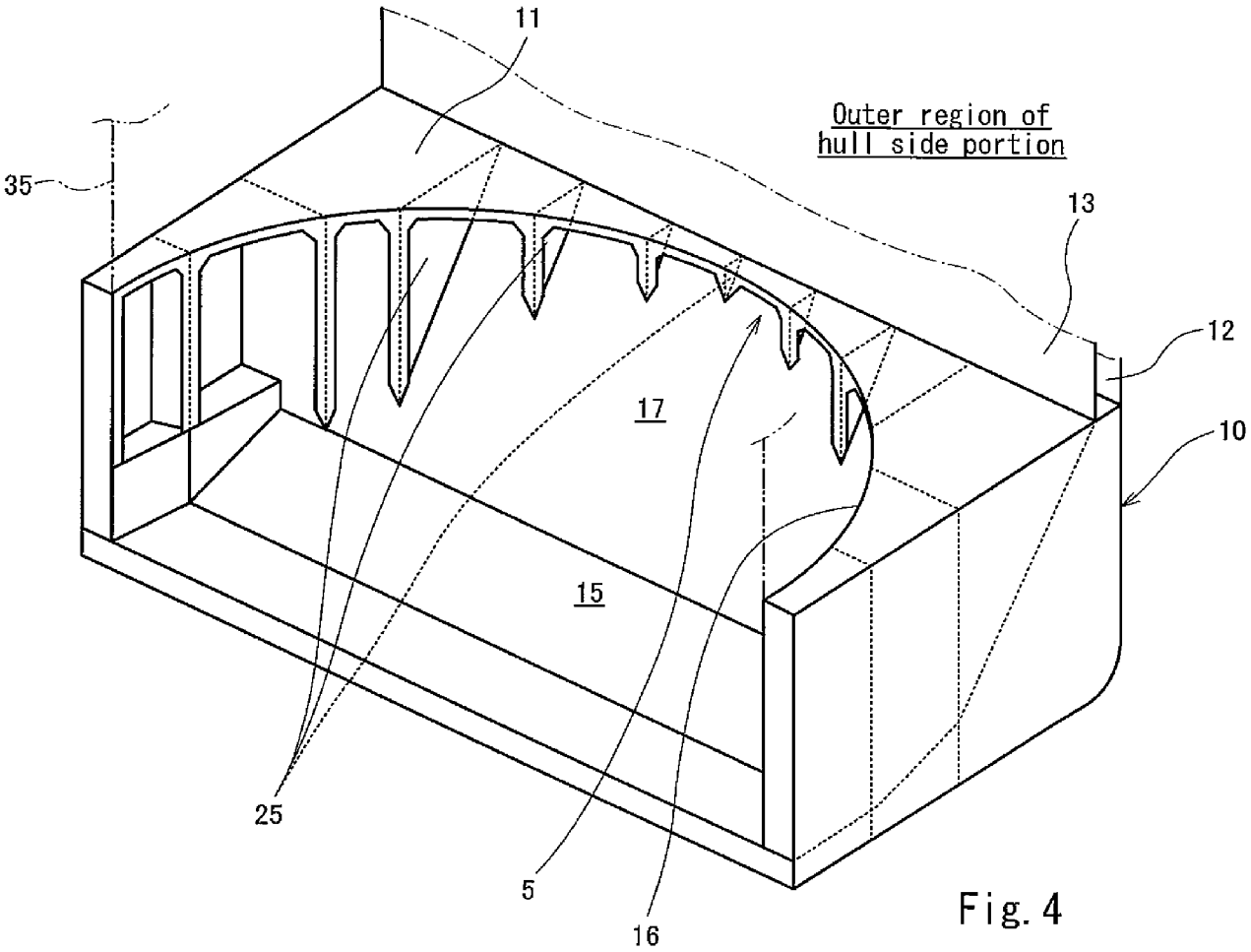
FIG. 4 is a perspective view showing a part of the hull structure of FIG. 2.

FIG. 4 is a perspective view showing a portion of the right part of the hull structure, which is partially extracted, the portion being located below the foundation deck 11. As shown in FIG. 4, the foundation deck 11 is provided with the circular opening 16 which is substantially equal in size to the skirt 35 having a cylindrical structure, and the reinforcement members 25 provided below the skirt 35 are disposed between the lower surface of the foundation deck 11 and the upper surface of each of the bilge hopper plates 17. In this way, the reinforcement members 25 are provided only on the inner side of each of the bilge hopper plates 17 of the hull structure.

Therefore, the reinforcement members 25 provided below the skirt 35 in the hull width direction are disposed only on the inner side of the pair of bilge hopper plates 17, and the reinforcement members 25 can be easily provided between the upper surfaces of the bilge hopper plates 17 and the foundation deck 11, by a work from the side of the upper surfaces of the bilge hopper plates 17. In addition, the reinforcement members 25 can have a simple structure. Thus, the work for providing the reinforcement members 25 can be carried out more efficiently. As a result, the work can be performed more easily, and work time and labor can be reduced.

As described above, in accordance with the above-described hull support structure 5, the hull structure such as the reinforcement members 25 provided below the skirt 35 supporting the spherical tank (liquefied gas tank) 30 can be simplified, and the members of the hull support structure 5 can be reduced. In addition, since the height of the skirt 35 supporting the spherical tank 30 can be reduced, the weight of the hull can be reduced.

Because of the reduction of the materials, material cost can be reduced. As a result, it becomes possible to construct the liquefied gas carrier (transportation vessel) 1 which can achieve reduction of the weight and reduction of the cost.

Although in the above-described embodiment, the foundation deck 11 is provided at an equal height over the entire hull cargo hold in the hull length direction, it is not necessary to extend the foundation deck 11 continuously at an equal height, and the configuration of the foundation deck 11 is not limited to the configuration of the above-described embodiment.

In the above-described embodiment, the liquefied gas carrier (transportation vessel) 1 of the MOSS type is exemplarily described, and the spherical tank 30 is exemplarily described as the liquefied gas tank. However, the present invention is applicable in the same manner to, for example, a liquefied gas tank of the MOSS type which is other than the spherical tank, so long as the liquefied gas tank is supported on the foundation deck 11 by the skirt 35, and the bilge hopper plates 17 are connected to the foundation deck 11. The shape or the like of the liquefied gas tank is not limited to the shape of the above-described embodiment.

Further, the above-described embodiment is merely exemplary, and can be changed in a variety of ways within the scope of the invention. The present invention is not limited to the above-described embodiment.

INDUSTRIAL APPLICABILITY

The hull support structure of the liquefied gas tank of the present invention can be utilized to realize, for example, reduction of the number of work steps of assembling the hull support structure of the liquefied gas tank, and reduction of the weight of the hull support structure.

REFERENCE SIGNS LIST

1 liquefied gas carrier (liquefied gas transportation vessel)
5 hull support structure
10 hull
11 foundation deck
12 side shell
13 longitudinal bulkhead
14 bottom plate
15 inner bottom plate
16 circular opening
17 bilge hopper plate
20 plate connection section
21 bulkhead connection section
22 skirt connection section
25 reinforcement member
30 spherical tank (liquefied gas tank)
31 first spherical tank
35 skirt (skirt structure)
H10 height

The invention claimed is:

1. A hull support structure of a liquefied gas tank, the hull support structure comprising:

a pair of side shells extending in a hull length direction, on both sides of a hull in a hull width direction;

a foundation deck disposed around the liquefied gas tank, the foundation deck connecting the pair of side shells to each other in the hull width direction, the foundation deck including a circular opening in the foundation deck in which a portion of the liquefied gas tank is disposed inward of the circular opening and supported by the circular opening;

a skirt supporting the liquefied gas tank on the foundation and around the opening;

an inner bottom plate extending in the hull length direction, at a location that is below the liquefied gas tank; and a pair of bilge hopper plates each of which is provided between the foundation deck and corresponding one of both end portions of the inner bottom plate, wherein a plate connection section, at which each of the pair of bilge hopper plates is connected to the foundation deck, is disposed outward in the hull width direction relative to a skirt connection section, at which the skirt is connected to the foundation deck.

2. The hull support structure of the liquefied gas tank according to claim 1, further comprising:

a pair of longitudinal bulkheads extending in the hull length direction along the pair of side shells, respectively, wherein the plate connection section, at which each of the pair of bilge hopper plates is connected to the foundation deck, conforms in a position in the hull width direction to a bulkhead connection section, at which each of the pair of longitudinal bulkheads is connected to the foundation deck.

3. The hull support structure of the liquefied gas tank according to claim 2, wherein each of the pair of bilge hopper plates is configured to linearly connect the inner bottom plate to the foundation deck.

4. A liquefied gas carrier comprising:

the hull support structure of the liquefied gas tank as recited in claim 1; and a plurality of liquefied gas tanks arranged in the hull length direction, each of the plurality of liquefied gas tanks being the liquefied gas tank of the hull support structure.

5. The liquefied gas carrier according to claim 4, wherein the foundation deck is provided at an equal height over an entire hull cargo hold in the hull length direction.

6. A liquefied gas carrier comprising:

the hull support structure of the liquefied gas tank as recited in claim 2; and a plurality of liquefied gas tanks arranged in the hull length direction, each of the plurality of liquefied gas tanks being the liquefied gas tank of the hull support structure.

7. A liquefied gas carrier comprising:

the hull support structure of the liquefied gas tank as recited in claim 3; and a plurality of liquefied gas tanks arranged in the hull length direction, each of the plurality of liquefied gas tanks being the liquefied gas tank of the hull support structure.

8. The liquefied gas carrier according to claim 6, wherein the foundation deck is provided at an equal height over an entire hull cargo hold in the hull length direction.

9. The liquefied gas carrier according to claim 7, wherein the foundation deck is provided at an equal height over an entire hull cargo hold in the hull length direction.

* * * * *